United States Patent [19]

Dameron, Jr.

[11] Patent Number: 4,987,717

[45] Date of Patent: Jan. 29, 1991

[54] GUTTER FACIA DESIGN ADAPTED FOR USE IN BOX BEAM APPLICATIONS

[76] Inventor: Joseph T. Dameron, Jr., 3357 E. Pennsylvania St., Tucson, Ariz. 85714

[21] Appl. No.: 123,557

[22] Filed: Nov. 20, 1987

[51] Int. Cl.[5] ..... E04C 3/30

[52] U.S. Cl. ..... 52/731; 52/11; 52/732

[58] Field of Search ..... 52/731, 11, 12, 15, 52/16, 732

[56] References Cited

U.S. PATENT DOCUMENTS

| | | | |
|---|---|---|---|
| 3,222,841 | 12/1965 | Lipof | 52/731 |
| 3,305,221 | 2/1967 | Kling | 52/731 |
| 3,349,538 | 10/1967 | Crossman | 52/731 |
| 3,491,485 | 1/1970 | Orman | 52/731 |
| 3,562,992 | 2/1971 | Kinsey | 52/731 |
| 3,596,427 | 8/1971 | Fernandez | 52/731 |
| 3,601,946 | 8/1971 | Rothemund | 52/731 |
| 3,613,329 | 10/1971 | Fernandez et al. | 52/731 |
| 3,634,992 | 1/1972 | Hughes | 52/731 |
| 3,728,837 | 4/1973 | Kiefer, Jr. | 52/731 |

*Primary Examiner*—Michael Safavi

*Attorney, Agent, or Firm*—Victor Flores; Harry M. Weiss

[57] ABSTRACT

A patio cover gutter facia is adapted with two substantially elongated side members which are provided with a complementary mating mechanical design for forming a box beam from interlocking two opposed identical gutter facia. One of the elongated sides of the gutter facia is provided with a screw groove for attaching to a roof panel in a common gutter application. The same side provided with the screw groove is also provided with a first lock member of an interlocked joint. The other one of the elongated sides is provided with a second lock member of an interlock joint. The method of fabricating the gutter facia of the is preferably from a low cost extruded aluminum process which will yield a quality product. In forming a box beam, two identical gutter facia are arranged opposing each other in an inverted interlocking relationship such that, a first lock member and a second lock member of a one gutter facia mates and interlocks respectively with a second lock member and a first lock member of a second gutter facia to form two separate, inverted identical interlocked joints.

2 Claims, 2 Drawing Sheets

GUTTER FACIA DESIGN ADAPTED FOR USE IN BOX BEAM APPLICATIONS

FIELD OF THE INVENTION

The present invention generally relates to gutter facia material used in the roof building industry. More particularly, the present invention relates to a patio cover gutter facia design which is adapted with elongated side members which are provided with a first and second end members each having a complementary mechanical design that produce two interlocked joints to form a box beam. The box beam is formed when a first lock member and a second lock member, of a first gutter facia, are respectively mated with a second lock member and a first lock member of a second identical gutter facia.

DESCRIPTION OF THE PRIOR ART

The prior art, as known to the applicant, is limited to the several types of pre-formed box beams or I-beam presently commercially available. The pre-formed box beams and I-beams are very costly due to the small quantities typically involved in placing purchase orders for any particular patio cover job to be done. Also, in order to meet building code requirements of a minimum structural strength of the spacing between beams, the pre-formed box beams and the I-beams available today must be placed closer together, which means more cost to building the structure. Another problem encountered with using the preformed box beams is one of time consumption when vertical posts must be attached to the beams. Typically, the post attachment requires installation of a bracket which must be fastened to the box beam by feeding a bolt through the interior portion of the box until a mounting hole is located. The process is further burdened by somehow providing a backup for tightening the bolt and nut used for fastening the bracket to the box beam.

The apparatus of the present invention possesses very substantial advantages over the prior art. These include economy of quantities in that the same part can now be used as a gutter facia as well a box beam, this has been found to lead to a quantity discount in price and lessens the part numbers used in inventory and stocking.

A very substantial advantage of the apparatus over the prior art is the solution to the time consuming process of adding a bracket to the box beam. With the present invention, the post bracket is easily installed to an gutter facia member prior to being mated to another gutter facia member to form a box beam of the present invention.

A primary object of the present invention is therefore to provide a box beam which may be formed from a gutter facia that is inexpensive to produce and which may be formed into a box beam having improved structural strength qualities.

Another object of the present invention is to provide a box beam design that solves a time consuming problem of attaching a bracket for installing a vertical post.

SUMMARY OF THE INVENTION

In a specific embodiment of present invention, a patio cover gutter facia is adapted with two substantially elongated side members which are provided with a complementary mating mechanical design for forming a box beam from interlocking two opposed identical gutter facia. One of the elongated sides of the gutter facia is provided with a screw groove for attaching to a roof panel in a common gutter application. The same side provided with the screw groove is also provided with a first lock member of an interlocked joint. The other one of the elongated sides is provided with a second lock member of an interlock joint. The method of fabricating the gutter facia of the present invention is preferably from a low cost extruded aluminum process which will yield a quality product.

In forming a box beam of the present invention, two identical gutter facia of the present invention are arranged opposing each other in an inverted interlocking relationship such that, a first lock member and a second lock member of a one gutter facia mates and interlocks respectively with a second lock member and a first lock member of a second gutter facia to form two separate, inverted identical interlocked joints.

It will become apparent from using the present invention that, whenever the vertical post location of a particular frame structure is fixed and a mounting bracket must be provided, such bracket may be preinstalled to a designated gutter facia which will form one half of a box beam to which the vertical post will be attached. This preinstallation will result in saving time in building the frame structure.

Therefore, to the accomplishments of the foregoing objects, the invention consists of the foregoing features hereinafter fully described and particularly pointed out in the claims, the accompanying drawing and following disclosure describing in detail the invention, such drawing and disclosure illustrating, however, but one of the various ways in which the invention may be practiced.

DETAILED DESCRIPTION OF THE PREFERRED EMBODIMENT

Figure 1:
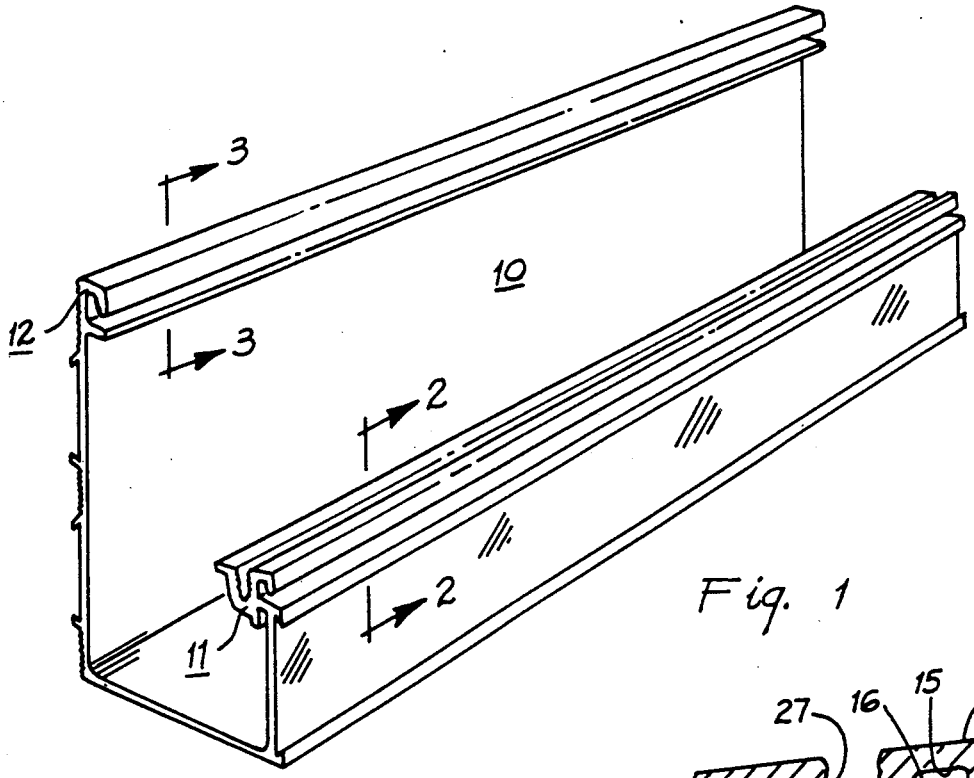
FIG. 1 shows a perspective view of the present invention illustrating the gutter facia member of the box beam apparatus provided with ends having different mechanical designs.
Figure 2:
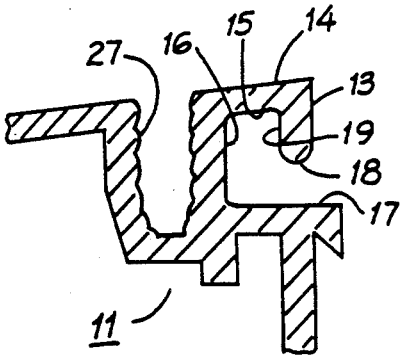
FIG. 2 shows a cross-sectional view taken along the line 2—2 in FIG. 1 showing a mechanical design of a first end member of the gutter facia provided with both a screw groove used for attaching the gutter facia to a roof panel and a first lock member of an interlocked joint.
Figure 3:
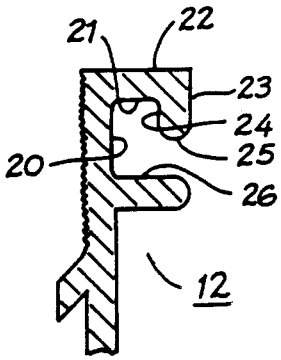
FIG. 3 shows a cross-sectional view taken along the line 3—3 in FIG. 1 showing a mechanical design of a second end member of the gutter facia provided with a second lock member of an interlocked joint.
Figure 4:
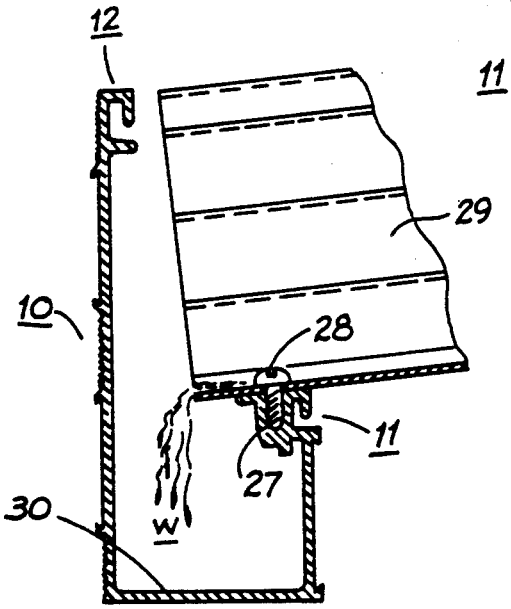
FIG. 4 is a cross-sectional elevation view showing the gutter facia of the present invention in use as a gutter facia utilizing the screw groove provided as well as showing the first and second lock members provided for other use.
Figure 6:
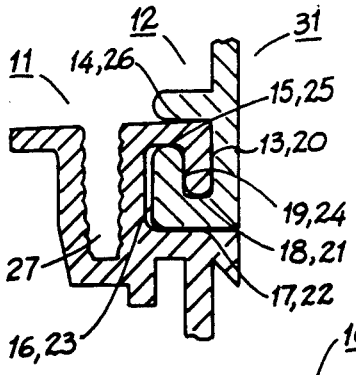
FIG. 6 is an enlarged cross-sectional view taken along the line 6—6 in FIG. 5 showing the interlocked joint produced by interlocking the first and second lock members.

Referring now to the drawings, wherein FIG. 1 shows a gutter facia 10 having ends 11 and 12 fabricated preferably from an extruded aluminum. As is best seen in FIGS. 2 and 3 end 11 and 12 are each provided with a complementary lock design which is intended to interlock as shown in FIG. 6. End 11 is shown in FIG. 2 with a screw grove 27 which is provided for purposes of attaching gutter facia 10 to a roof panel 29 using screw 28, see FIG. 4. Screw groove 27 is provided solely for using gutter facia 10 as a common gutter device as shown in FIG. 4 wherein gutter portion 30 is collecting water from panel 29. Also shown in FIG. 4, are ends 11 and 12, wherein the complementary lock design provided at each end are not used when a gutter application is intended.

Figure 5:
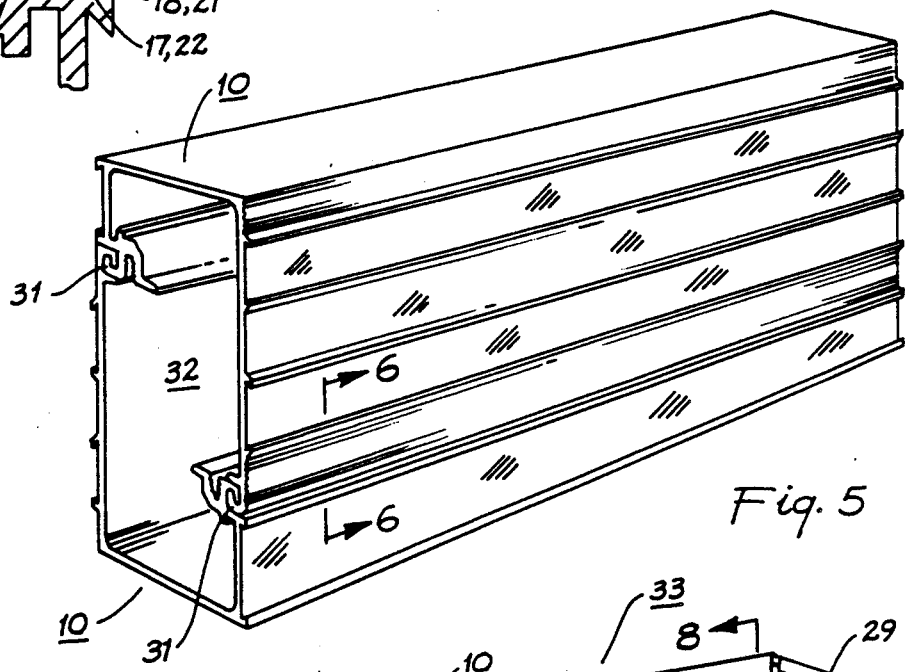
FIG. 5 is a perspective view of the box beam of the present invention whereby the box beam is formed by interlocking two identical gutter facia units of the present invention.

The lock designs contained at ends 11 and 12 of gutter facia 10 are provided so that two identical gutter facia 10 can be interlocked as shown in FIG. 5 to create a box beam 32. The lock 31 created by mating an end 11 on one gutter facia 10 with an end 12 on a second gutter facia 10 is best understood by referring to FIGS. 2, 3 and 6 where it is seen that the lock design of end 11 resembles the letter "F" considering lock members 18, 13, 14, 16 and 17 and also interior lock members 15 and 19. The lock design provided on end 12 is seen to also resemble the letter "F" considering lock members 25, 23, 22, 20, and 26 and also interior lock members 24 and 21.

FIG. 6 shows lock 31 wherein lock members from ends 11 and 12 on two separate, yet identical, gutter facia 10 are interlocked such that the openings between lock members 17 and 18 on end 11 and 25 and 26 provide the key hole from one set of locking members on end 11 to the other set of locking members on end 12. When lock 31 is formed, locking members 17, 22 and 18, 21 and 19, 24 and 13, 20 and 15, 25 and 14, 26 and 16, 23 are in a closely interlocked relationship that produces a strong bond between the two gutter facia to form a yet stronger box beam of the present invention.

Figure 7:
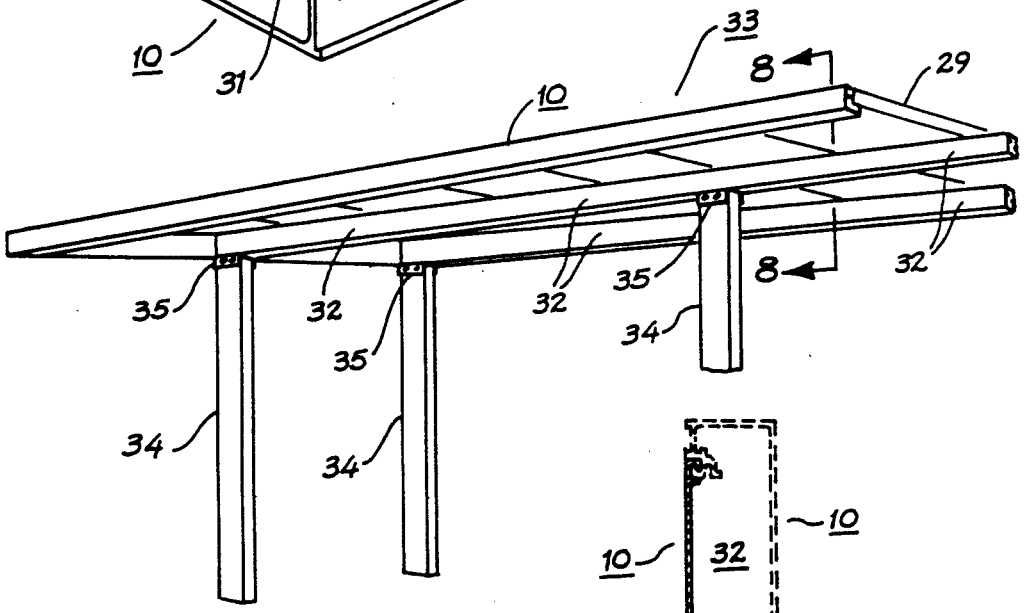
FIG. 7 is a partial frame structure depicting a typical application of the gutter facia and the box beam formed by interlocking two gutter facia.

FIG. 7 show a typical frame structure 34 utilizing the gutter facia 10 at one end of roof panel 29, having vertical posts 34 attached to box beam 32 by means of brackets 35 and hardware 37 and 38.

Figure 8:
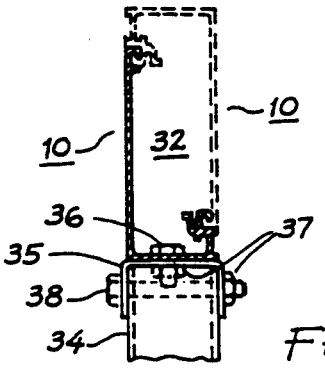
FIG. 8 is an enlarged cross-sectional view of a vertical post bracket pre-attached to a gutter facia member of a box beam, illustrating a time savings advantage of the present invention.

FIG. 8 shows a clear advantage of box beam 32 over the prior art in that bracket 35 may be preinstalled using hardware 36 and 37 to one of the gutter facia members 10 of a yet to be assembled box beam 32.

Therefore, while the present invention has been shown and described herein in what is believed to be the most practical and preferred embodiment, it is recognized that departures can be made therefrom within the scope of the invention, which is therefore not to be limited to the details disclosed herein but is to be accorded the full scope of the claims so as to embrace any and all equivalent apparatus.

I claim:

1. A box beam apparatus, said apparatus comprising:

(a) a first and second, substantially L-shaped, interlocked patio cover gutter facia, each gutter facia including: a first side member, said first side member being elongated and having an upper terminating end, a second side member, said second side member being elongated and having a height lower than said first side member and also having an upper terminating end, a first, substantially F-shaped, locking member of a lock design, said first, substantially F-shaped, locking member being located at said upper end of said first side member, and a second, substantially F-shaped, locking member of a lock design, said second F-shaped locking member being located at said upper end of said second side member, an elongated screw groove provided on said second side member adjacent to said second, substantially F-shaped locking member, said screw groove being used for attaching said gutter facia to an underside of a roof when said gutter facia is to be used as a gutter facia and said first and second F-shaped locking members being used in forming said box beam apparatus; and (b) at least two locks, said locks being created by interlocking said first and second, substantially F-shaped locking members on said first gutter facia, respectively with, a second and first, substantially F-shaped, locking member on said second identical gutter facia.

2. A substantially L-shaped, dual-purpose, patio cover gutter facia apparatus adapted for use as a gutter facia and a box beam, said apparatus comprising:

(a) a first side member, said first side member being elongated and having an upper terminating end;

(b) a second side member, said second side member being elongated and having a height lower than said first side member and also having an upper terminating end;

(c) a first, substantially F-shaped, locking member of a lock design, said first, substantially F-shaped, locking member being located at said upper end of said first side member;

(d) a second, substantially F-shaped, locking member of a lock design, said second, substantially F-shaped, locking member being located at said upper end of said second side member; and (e) an elongated screw groove provided on said second side member adjacent to said second, substantially F-shaped locking member, said screw groove being used for attaching said gutter facia to an underside of a roof, said first and second F-shaped locking members being used in forming said box beam from a pair of said gutter facia.

* * * * *